US006822660B2

(12) United States Patent
Kim

(10) Patent No.: US 6,822,660 B2
(45) Date of Patent: Nov. 23, 2004

(54) DISPLAY APPARATUS WITH IMPROVED SENSING SPEED OF RESOLUTION CHANGE AND SENSING METHOD THEREOF

(75) Inventor: Min-Su Kim, Kyunggi-do (KR)

(73) Assignee: Samsung Electronics Co., Ltd. (KR)

( * ) Notice: Subject to any disclaimer, the term of this patent is extended or adjusted under 35 U.S.C. 154(b) by 275 days.

(21) Appl. No.: 09/918,254

(22) Filed: Jul. 30, 2001

(65) Prior Publication Data

US 2002/0145597 A1 Oct. 10, 2002

(30) Foreign Application Priority Data

Apr. 6, 2001 (KR) ..... 2001-18212

(51) Int. Cl.[7] ..... G09G 5/00
(52) U.S. Cl. ..... 345/699; 345/204; 345/213
(58) Field of Search ..... 345/3.1–3.4, 98–100, 345/204, 698, 699, 211–213; 348/558, 556, 553, 521, 524, 500, 510, 513, 525, 526

(56) References Cited

U.S. PATENT DOCUMENTS 5,025,496 A * 6/1991 Canfield ..... 348/526
5,576,770 A * 11/1996 Rumreich ..... 348/525
6,130,721 A * 10/2000 Yoo et al. ..... 348/558
6,392,642 B1 * 5/2002 Wu ..... 345/213
6,577,322 B1 * 6/2003 Fukuda ..... 345/698

FOREIGN PATENT DOCUMENTS

GB 2 319 921 A * 6/1998 ..... H04N/5/44
JP 09-035395 * 5/1997 ..... H04N/5/44

* cited by examiner

*Primary Examiner*—Alexander Eisen
(74) *Attorney, Agent, or Firm*—F. Chau & Associates LLC

(57) ABSTRACT

A display apparatus is provided for displaying a picture signal which is synchronized with a synchronization signal provided from a host. The display apparatus includes: a counting circuit for counting a first number of pulses of the synchronization signal provided from the host, and generating a counted number of pulses in a predetermined time period; a register for storing the first number of the pulses provided from the counting circuit; and a comparator for comparing a second number of pulses newly provided from the counting circuit with the first number of pulses stored in the register, and generating a resolution change sensing signal when the first number of pulses and the second number of pulses are different.

18 Claims, 6 Drawing Sheets

DISPLAY APPARATUS WITH IMPROVED SENSING SPEED OF RESOLUTION CHANGE AND SENSING METHOD THEREOF

This application relies for priority upon Korean Patent Application No. 2001-18212, filed on Apr. 6, 2001, the contents of which are herein incorporated by reference in their entirety.

BACKGROUND OF THE INVENTION

1. Field of the Invention

The present invention generally relates to a display apparatus, and more particularly to a display apparatus with improved sensing speed of resolution change and sensing method thereof.

2. Description of the Related Art

Cathode-ray tube (CRT) display apparatus produces images on a screen by generating electron beam which strikes a phosphorescent surface of the screen. An electric gun installed in a rear portion of the apparatus generates the beam of electrons, which are deflected by horizontal and vertical polarization coils for alternating the direction of the beam. The screen displays the images when portions of the screen are struck by the electron beam. The CRT display apparatus displays characters and images on screen, and it is commonly utilized as a computer output device.

The electron beam is scanned periodically in accordance with a period of sawtooth current of a deflecting yoke, but the period should be synchronized with a scanning period required for a host. Synchronization is achieved by a synchronization signal sent from the host. The synchronization signal is divided into a horizontal synchronization signal controlling a horizontal scanning period, and a vertical synchronization signal controlling a vertical scanning period.

Meanwhile, the resolution change in the CRT display apparatus is achieved by the frequency change of the horizontal and vertical synchronization signals provided from the host. For instance, for the video graphic array (VGA) representing 640×480 pixels, the frequency of horizontal synchronization signal is 30 KHz and the frequency of the vertical synchronization signal is 60 Hz. For super VGA (SVGA) representing 1024×768 pixels, the frequency of horizontal synchronization signal is 35–37 KHz and the frequency of the vertical synchronization signal is 70 Hz.

The resolution change in the CRT display apparatus is achieved by the frequency change of the horizontal and vertical synchronization signals provided from the host. The conventional CRT display apparatus senses the resolution change by detecting one period of the vertical synchronization signal, and calculates the number of pulses of the horizontal synchronization signal provided from the host during the detected period of the vertical synchronization signal.

However, if the resolution of the display apparatus is changed, e.g., from VGA to SVGA, or from SVGA to VGA, component circuits for the CRT display apparatus are often damaged due to the sudden operating frequency change, and a large amount of time is required for sensing the resolution change.

SUMMARY OF THE INVENTION

A display apparatus displaying a picture signal synchronized with a synchronization signal provided from a host is provided, wherein the display apparatus includes: a counting circuit for counting a first number of pulses of the synchronization signal provided from the host, and generating a counted number of pulses in a predetermined time period; a register for storing the first number of the pulses provided from the counting circuit; and a comparator for comparing a second number of pulses newly provided from the counting circuit with the first number of pulses stored in the register, and generating a resolution change sensing signal when the first number of pulses and the second number of pulses are different. Preferably, the counting circuit includes: a counter for counting the number of pulses of the synchronization signal; a timer for generating a control signal every predetermine time period; and a switching circuit transferring the counted number of pulses to an output in response to the control signal.

According to an aspect of the invention, the timer generates the control signal every 1 millisecond, and the synchronization signal is a horizontal synchronization signal.

A display apparatus for displaying a picture signal synchronized with a composite signal of a horizontal synchronization signal and a vertical synchronization signal is also provided which comprises: a synchronization signal separator for dividing the composite signal into the horizontal synchronization signal and the vertical synchronization signal; a counting circuit for counting a first number of pulses of the horizontal synchronization signal separated from the synchronization signal separator, and generating a counted number of pulses in a predetermined time period; a register for storing the first number of pulses provided from the counting circuit; and a comparator for comparing a second number of pulses newly provided from the counting circuit with the first number of pulses stored in the register, and generating a resolution change sensing signal when the first number of pulses and the second number of pulses are different.

According to a preferred embodiment of the present invention, the horizontal synchronization signal separated from the synchronization signal separator is same as the composite signal.

The synchronization signal separator includes an up/down counter performing an up-count when the composite signal is a first level, and performing a down-count when the composite signal is a second level, and an overflow signal provided from the up/down counter is the vertical synchronization signal.

The counting circuit includes: a counter counting the number of pulses of the horizontal synchronization signal separated from the synchronization signal separator, and generating the counted number of pulses; a timer generating a control signal in a predetermined time period; and a switching circuit transferring the counted number of pulses from the counter to an output in response to the control signal, wherein the counter is reset by the control signal provided from the timer. The timer generates the control signal every 1 millisecond.

According to a preferred embodiment of the present invention, the display apparatus further includes a flag register being set during an activating period of the vertical synchronization signal separated from the synchronization signal separator, wherein the comparator performs a frequency correction for the vertical synchronization signal included in the horizontal synchronization signal when the flag register is set. A method for sensing resolution change in a display apparatus displaying a picture signal synchronized with a synchronization signal provided from a host is provided, wherein the steps include: generating a first counted number of pulses in a first predetermined time period by counting a first number of pulses of the synchronization signal from the host; generating a second counted number of pulses in a second predetermined time period by counting a second number of pulses of the synchronization signal from the host; comparing the first counted number of pulses and the second counted number of pulses; and generating a resolution change sensing signal when the first counted number of pulses and the second counted number of pulses are different.

BRIEF DESCRIPTION OF THE DRAWINGS

The above and other objects, features and advantages of the present invention will become more apparent from the following detailed description when taken in conjunction with the accompanying drawings in which.

DESCRIPTION OF PREFERRED EMBODIMENTS

In the following description for purposes of explanation, specific numbers, materials and configurations are set forth in order to provide a thorough understanding of the present invention. However, it will be apparent to one skilled in the art that the present invention may be practiced without the specific without the specific details. In other instances, well-known systems are shown in diagrammatic or block diagram form in order not to obscure the present invention.

Preferred embodiments according to the present invention will be explained with reference to FIGS. 1 through 6 hereinafter.

Figure 1:
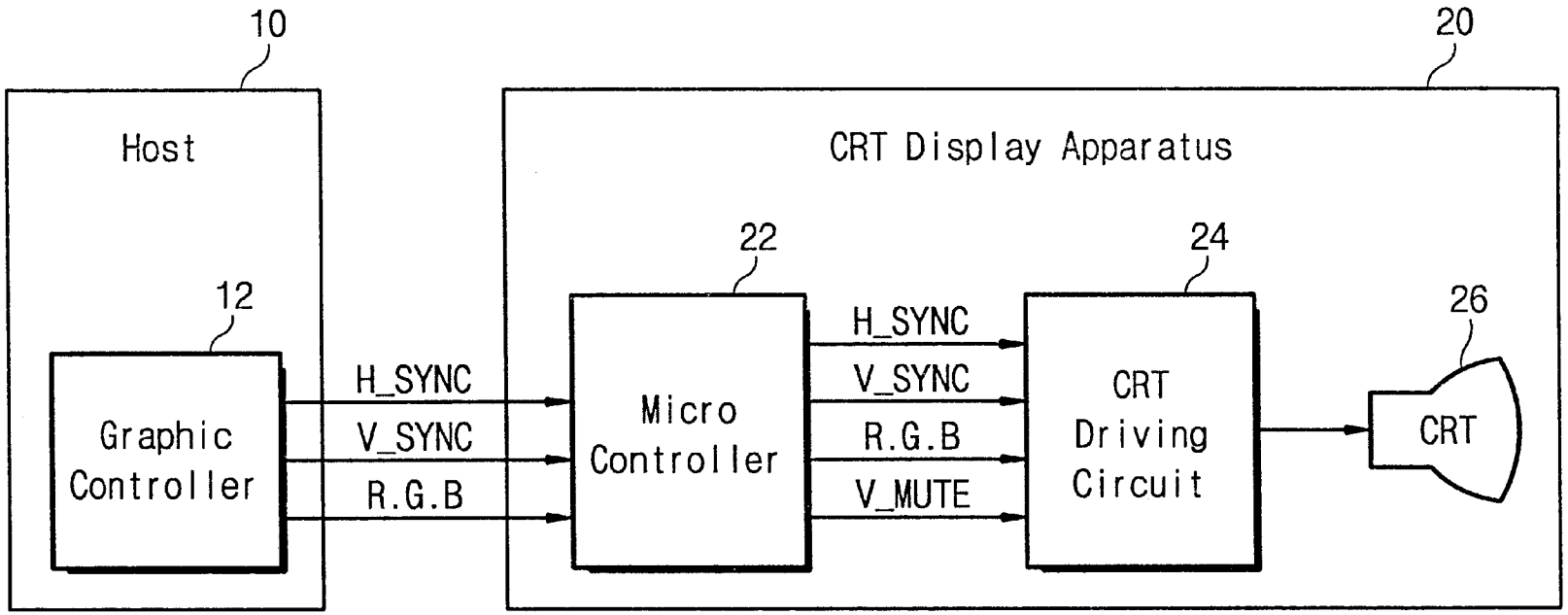
FIG. 1 is a block diagram of a host system and a cathode-ray tube (CRT) display apparatus according to a preferred embodiment of the present invention.

FIG. 1 shows a relation of a host 10 with a cathode-ray tube (CRT) display apparatus 20 applied to a preferred embodiment of the present invention.

Referring to FIG. 1, the CRT display apparatus 20 includes a micro controller 22, a CRT driving circuit 24, and a CRT 26. The CRT display apparatus 20 displays analog picture signals R(red), G(green), and B(blue) provided from a graphic controller 12 of the host 10 on a CRT 26 by synchronously responding to a horizontal synchronization signal H_SYNC and a vertical synchronization signal V_SYNC. The micro controller 22 senses the frequency of the horizontal synchronization signals H_SYNC and the vertical synchronization signals V_SYNC provided from the host 10 to determine whether a resolution is changed, and generates a signal V_MUTE for the CRT 26 to mute the video when the resolution is changed. The CRT driving circuit 24 forces the CRT 26 to be video mute in response to the signal V_MUTE provided from the micro controller 22.

Figure 2:
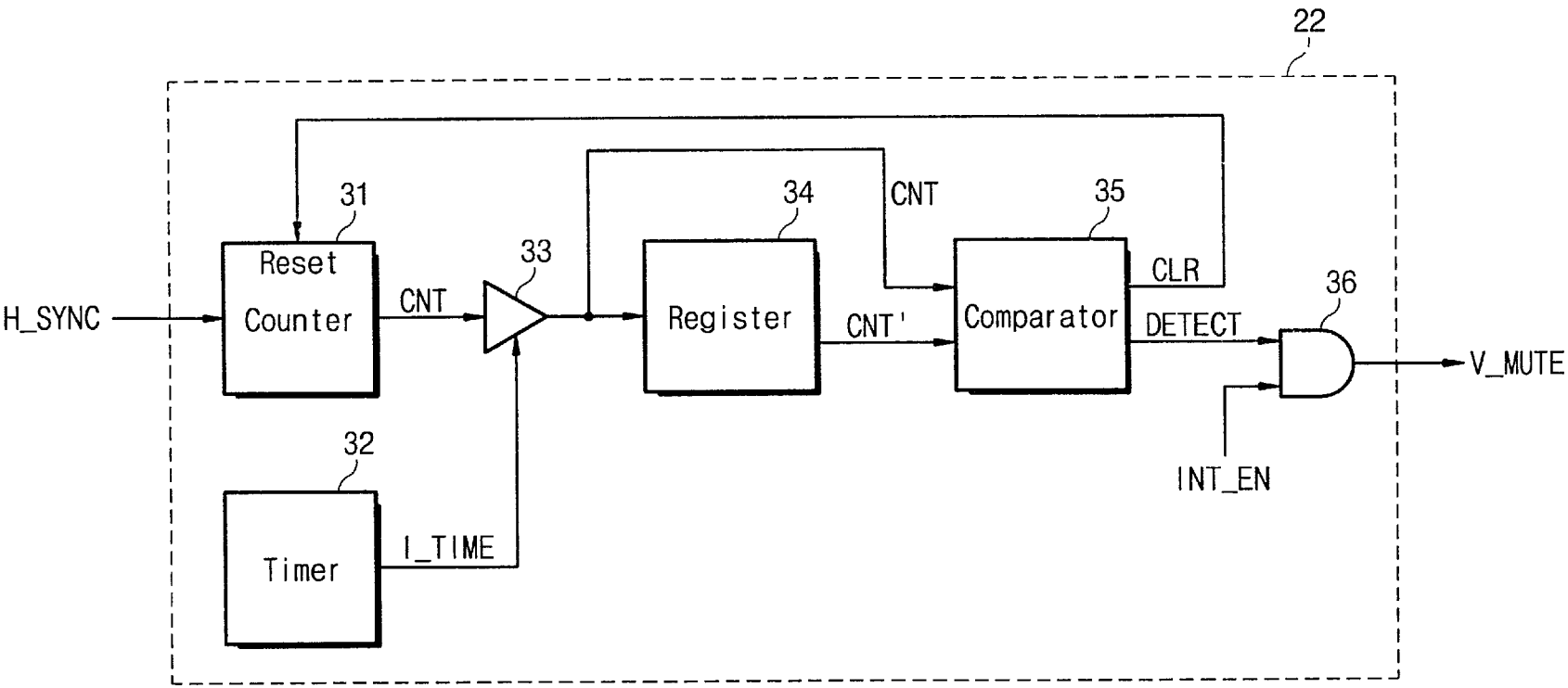
FIG. 2 is a block diagram of a micro controller shown in FIG. 1.

FIG. 2 shows an embodiment of the micro controller 22 shown in FIG. 1.

Referring to FIG. 2, the micro controller 22 includes a counter 31 connected to the host 10 at its input and connected to a three state buffer 33 at its output, a timer 32 connected to the three state buffer at its output, the three state buffer 33 connected to a register 34 at its one output and connected to a comparator 35 at its other output, the register 34 connected to the comparator 35 at its output, the comparator 35 connected to the AND gage 36 at its one input and connected to the counter 31 at its other output, and the AND gate 36. The micro controller 22 determines whether the resolution is changed by sensing the frequency of the horizontal synchronization signal H_SYNC provided from the host 10 (in FIG. 1), and generates the signal V_MUTE for the CRT 26 (in FIG. 1) to be video mute when the resolution is changed.

Figure 3:
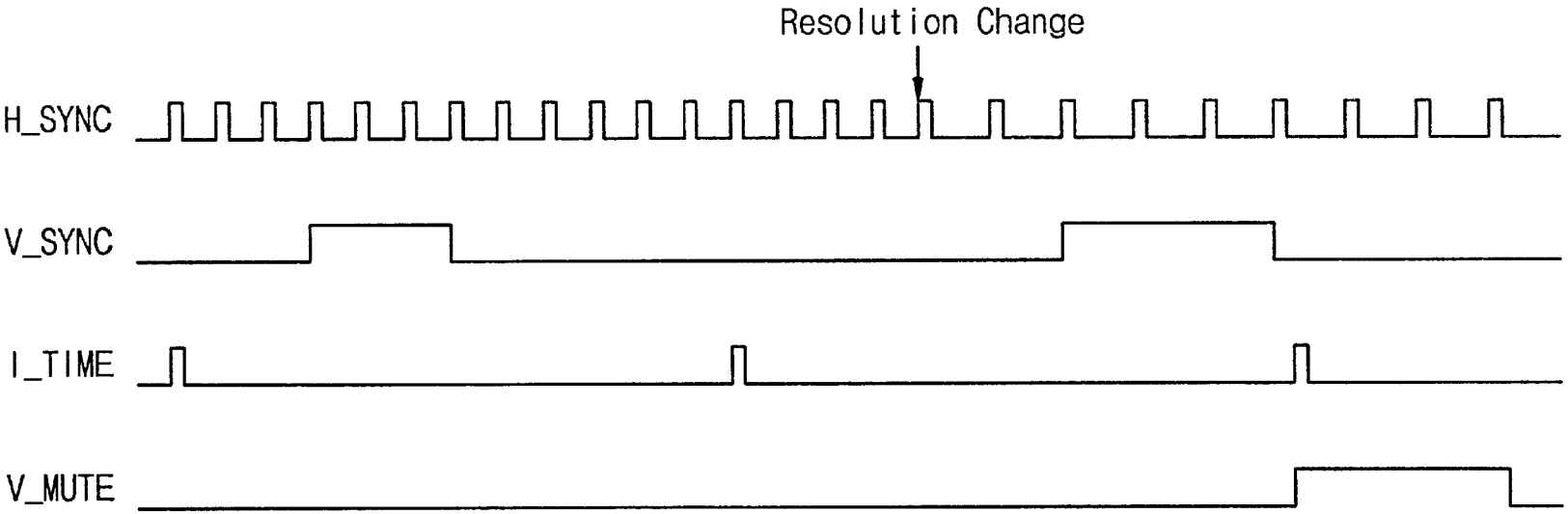
FIG. 3 is a timing diagram of video mute signal generation according to a preferred embodiment of the present invention.

Continuing to refer to FIGS. 2 through 4, an operation of the micro controller will be explained according to a preferred embodiment of the present invention. FIG. 3 shows an output of the video mute signal V_MUTE in case that the horizontal synchronization signal H_SYNC provided from the host 10 (in FIG. 1) is changed, and FIG. 4 is a flow chart showing an operational sequence of the micro controller 22 according to a preferred embodiment of the present invention.

Figure 4:
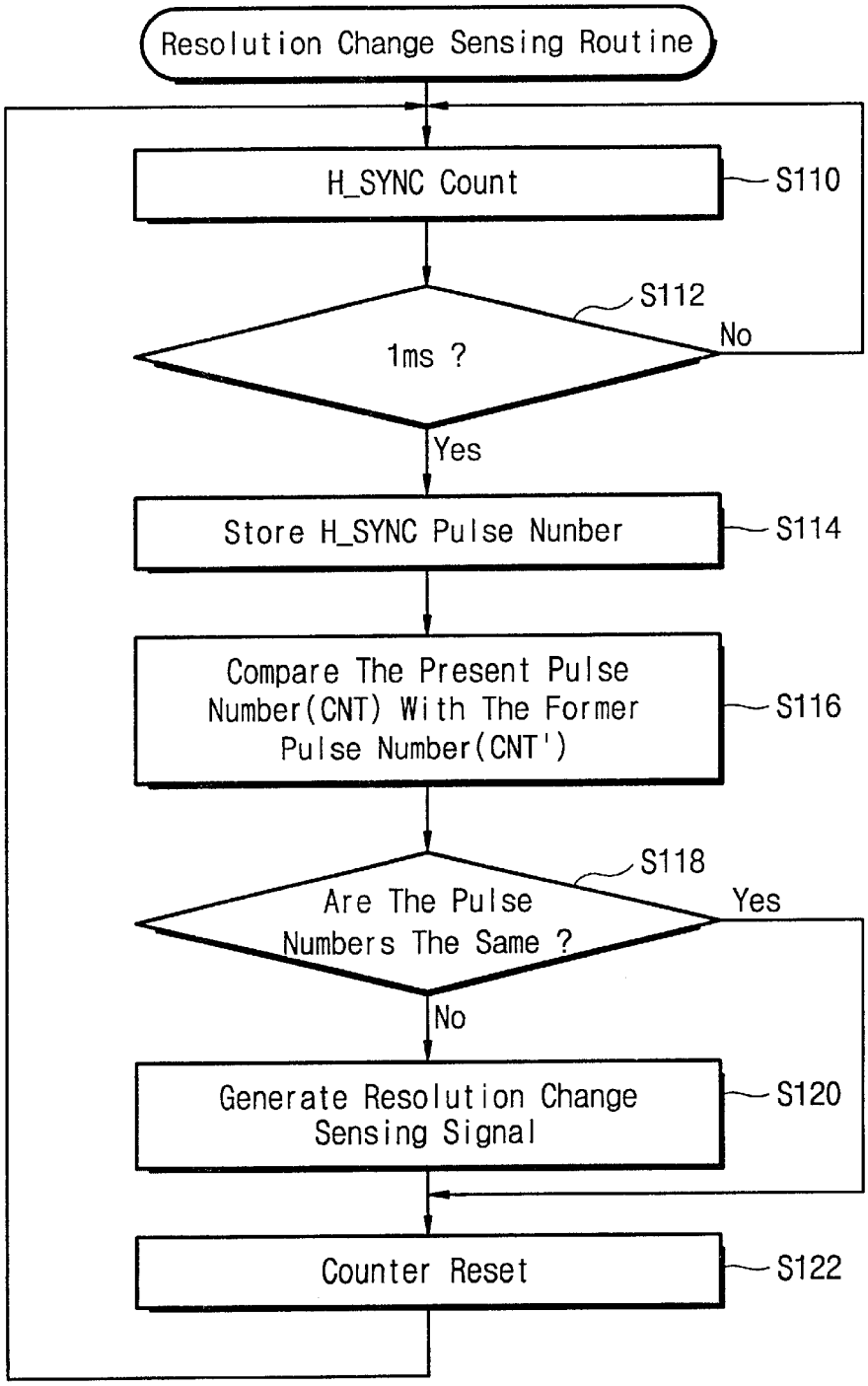
FIG. 4 is a flow chart of an operation of the micro controller according to a preferred embodiment of the present invention.

The counter 31 counts a pulse number CNT of the horizontal synchronization signal H_SYNC provided from the host 10 (in FIG. 1) and generates the same signal (step S110, in FIG. 4). The timer 32 generates control signal I_TIME in a predetermined times period, e.g., 1 millisecond(ms). The three state buffer 33 transfers the counted pulse number CNT in the counter 31 to the output in response to the control signal I_TIME (step S112, in FIG. 4). The register 34 stores the pulse number CNT provided from the counter 31 through the buffer 33 (step S114, in FIG. 4). The comparator 35 compares the pulse number CNT newly provided from the counter 31 through the buffer 33 with former pulse number CNT' stored in the register 34 (step S116, in FIG. 4). If the frequency of the horizontal synchronization signal H_SYNC provided from the host 10 (in FIG. 1) is changed, the pulse number CNT newly provided from the counter 31 comes to be different with the former pulse number CNT' stored in the register 34. The comparator 35 discriminates whether the pulse numbers CNT and CNT' are same (step S118, in FIG. 4), and generates resolution change sense signal DETECT of high level (i.e., logic '1') when the numbers are different between CNT and CNT' (step S120, in FIG. 4). When the numbers between CNT and CNT' are same, the comparator 35 generates a signal CLR to reset the counter 31 (step S122, in FIG. 4). In case that an interrupt enable signal INT_EN is activated on high level, the AND gate 36 generates the video mute signal V_MUTE of high level.

It is assumed that the timer 32 generates the control signal I_TIME every 1 ms, when the frequency of the horizontal synchronization signal for the VGA is 30 KHz and the frequency of the horizontal synchronization signal for the SVGA is 37 KHz. Then, the pulse number CNT of the horizontal synchronization signal H_SYNC provided from the host 10 (in FIG. 1) for 1 ms is 300 for the VGA, and 370 for the SVGA. Thus, it is possible to easily detect whether the resolution is changed by counting the pulse number CNT of the horizontal synchronization signal H_SYNC provided from the host 10 (in FIG. 1) for a predetermined time period.

In this embodiment, the period when the control signal I_TIME is generated from the timer 32 is 1 ms, which can be variously modified. For instance, if the frequency of the vertical synchronization signal in VGA is 60 Hz, the period is 1.7 ins. If the frequency of the vertical synchronization signal in SVGA is 70 Hz, the period is 10.4 ms. In the conventional art, the resolution change is sensed by detecting one period of the vertical synchronization signal, and calculating the pulse number of the signal provided from the host during the detected period. Thus, it requires a lot of time for sensing the resolution change. On the contrary, in the present invention, the resolution change is sensed by counting the pulse number of the horizontal synchronization signal for a predetermined time period without respect of the period of the vertical synchronization signal, and comparing the counted pulse number with a pulse number being previously counted. Thus, the time for sensing the resolution change can be reduced.

Another embodiment where the resolution change is detected from the composite signal provided from the host 10 (FIG. 1) is explained hereinafter.

Figure 5:
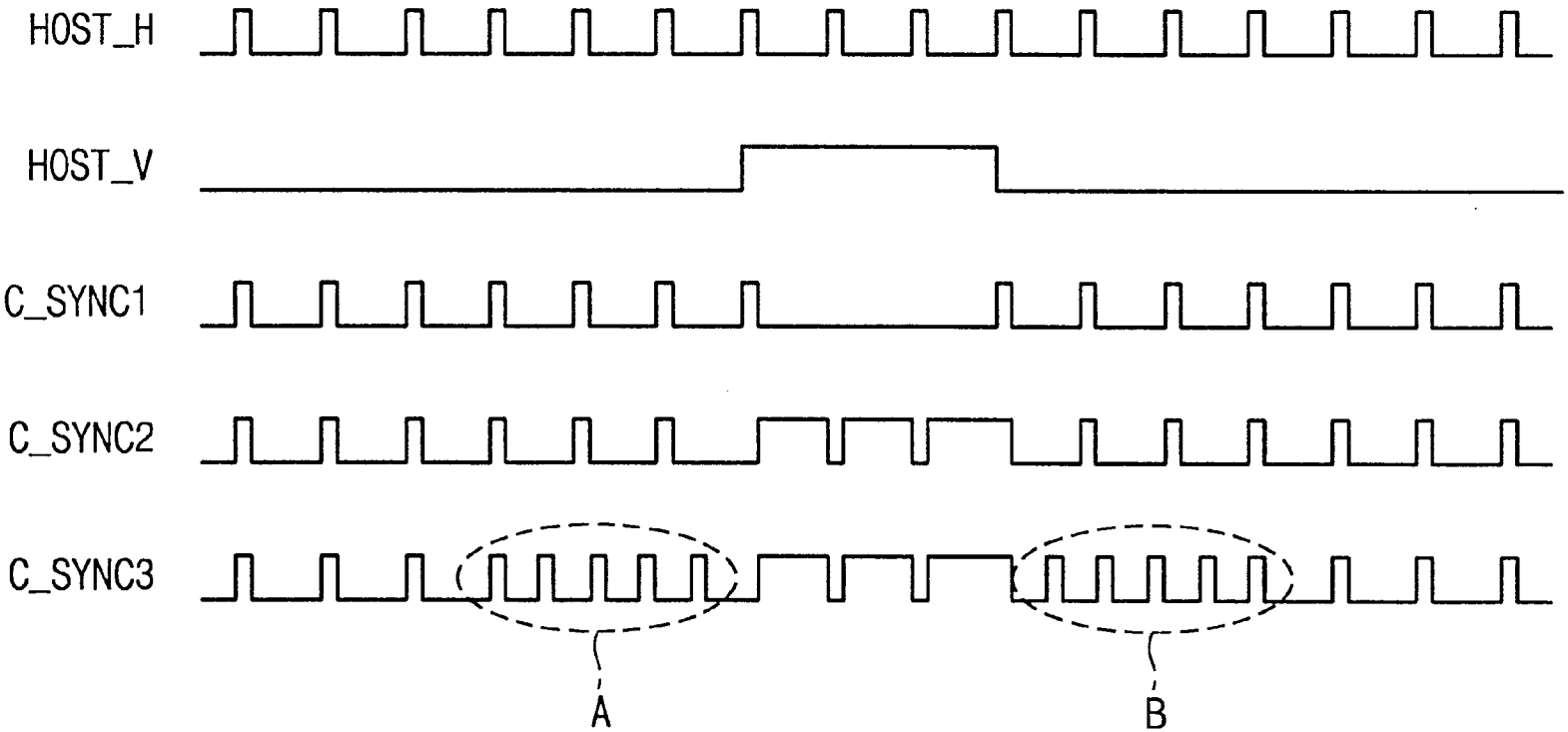
FIG. 5 is a timing diagram of the composite signals in various shapes depending on the horizontal and vertical synchronization signals generated in the host.

FIG. 5 shows exemplary frequency shapes for the composite signals C_SYNC1, C_SYNC2, and C_SYNC3 from the host 10 (FIG. 1) in accordance with a horizontal synchronization signal HOST_H and a vertical synchronization signal HOST_V generated. Referring to FIG. 5, the shapes of the composite signals C_SYNC1, C_SYNC2, and C_SYNC3 have similar shapes with the horizontal synchronization signal HOST_H while the vertical synchronization signal HOST_V is low level. On the other hand, while the vertical synchronization signal HOST_V changes to high level, the composite signals C_SYNC1, C_SYNC2, and C_SYNC3 have different shapes of frequency. Particularly, the composite signal C_SYNC3 has different shape of frequency around the period while the vertical synchronization signal HOST_V is high level. In such composite signal, it is necessary that the resolution change is sensed in different manner from the case that the composite signal is provided to the CRT device by being divided into the horizontal and vertical synchronization signals.

Figure 6:
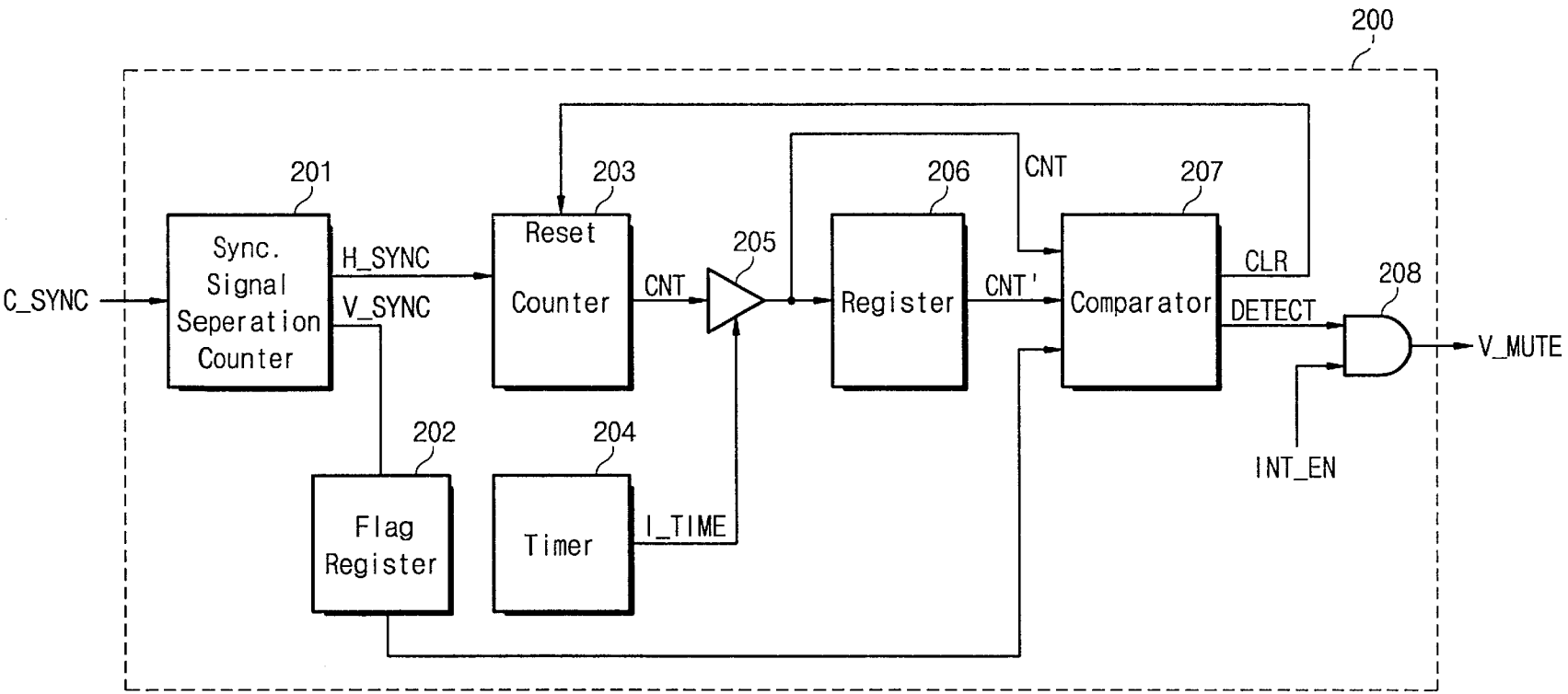
FIG. 6 is a schematic block diagram of the micro controller according to another embodiment of the present invention.

FIG. 6 shows the circuit architecture of the micro controller for sensing the resolution change, in case that composite signal composed of the horizontal and vertical synchronization signals from the host is provided to the CRT device.

Referring to FIG. 6, the micro controller 200 further includes a synchronization signal separation counter 201 connected to the counter 203 at its output and a flag register 202 connected to the synchronization signal separation counter 201 at its input, being added to the circuit architecture shown in FIG. 2.

The synchronization signal separation counter 201 is formed of 5-bit up/down counter, and performs an up-count while the composite signal C_SYNC is high level and a down-count while the composite signal C_SYNC is low level. The synchronization signal separation counter 201 is to be overflown while the vertical synchronization signal of the composite signal C_SYNC is activated. The overflow signal of the synchronization signal separation counter 201 is provided as the vertical synchronization signal V_SYNC.

The flag register 202 is set to '1' when the vertical synchronization signal V_SYNC is high level. The comparator 207 connected to the AND gate 208 at its one output and connected to the counter 203 at its other output achieves a frequency correction for the vertical synchronization signal included in the horizontal synchronization signal, while the flag register 202 is set. For instance, in case that the composite signal C_SYNC provided from the host 10 (in FIG. 1) is the shape of the composite signal C_SYNC3 shown in FIG. 5, the counted pulse number for 1 ms is come to be different, since the frequency is changed around the activating period of the vertical synchronization signal, i.e., A and B (in FIG. 5) regardless of the resolution change. The comparator 207 performs error corrections such as A or B periods (in FIG. 5) when comparing the pulse number CNT newly provided from the counter 203 with the pulse number CNT' stored in the register 206, and senses that there is no resolution change when the difference of numbers CNT and CNT' is included in the error range.

Another way to sense the resolution change when the composite signal is provided from the host 10 (in FIG. 1) is that the counted pulse number CNT in the counter 203 is ignored while the flag register 202 is set. In other words, the comparing operation in the comparator 207 is not performed while the flag register 202 is set to '1'. And the pulse numbers are compared between before setting to '1' and after changing from '1' to '0'. It can be sufficiently achieved by slightly modifying the micro controller 200 shown in FIG. 6.

According to the present invention, the resolution change is detected by counting the pulse number of the horizontal synchronization signal during a predetermined time period without respect to the period of the vertical synchronization signal, and comparing the counted number with the former counted number. Thus, the time required for sensing the resolution change is reduced.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A display apparatus for displaying a picture signal synchronized with a synchronization signal provided from a host, the display apparatus comprising:

a counting circuit for counting a first number of pulses of the synchronization signal provided from the host, and generating a counted number of pulses in a predetermined time period;

a register for storing the first number of the pulses provided from the counting circuit; and a comparator for comparing a second number of pulses newly provided from the counting circuit with the first number of pulses stored in the register, and generating a resolution change sensing signal when the first number of pulses and the second number of pulses are different, wherein the counting circuit comprises a counter for counting the number of pulses of the synchronization signal and the counter is reset by a control signal from the comparator, and wherein the synchronization signal is a horizontal synchronization signal.

2. The display apparatus of claim 1, wherein the counting circuit further comprises:

a timer for generating a control signal every predetermined time period; and a switching circuit transferring the counted number of pulses to an output in response to the control signal generated by the timer.

3. The display apparatus of claim 2, wherein the timer generates the control signal every 1 millisecond.

4. A display apparatus for displaying a picture signal synchronized with a composite signal of a host horizontal synchronization signal and a host vertical synchronization signal, the display apparatus comprising:

a synchronization signal separator for dividing the composite signal into a horizontal synchronization signal and a vertical synchronization signal;

a counting circuit for counting a first number of pulses of the horizontal synchronization signal outputted from the synchronization signal separator, and generating a counted number of pulses every predetermined time period;

a register for storing the first number of pulses provided from the counting circuit; and a comparator for comparing a second number of pulses newly provided from the counting circuit with the first number of pulses stored in the register, and generating a resolution change sensing signal when the first number of pulses and the second number of pulses are different, wherein the counting circuit comprises a counter for counting the number of pulses of the horizontal synchronization signal outputted from the synchronization signal separator and the counter is reset by a control signal provided from the comparator.

5. The display apparatus of claim 4, wherein the horizontal synchronization signal outputted from the synchronization signal separator is the same as the composite signal.

6. The display apparatus of claim 4, further comprising a flag register, wherein, when the vertical synchronization signal outputted from the synchronization signal separator is activated, the flag register is set and the comparator determines whether a difference between the first number of pulses and the second number of pulses is due to a resolution change or a frequency change in the composite signal resulting from activation of the host vertical synchronization signal.

7. The display apparatus of claim 4, wherein the synchronization signal separator comprises an up/down counter performing an up-count when the composite signal is a first level, and performing a down-count when the composite signal is a second level, and an overflow signal provided from the up/down counter is the vertical synchronization signal.

8. The display apparatus of claim 4, wherein the counter generates the counted number of pulses and the counting circuit further comprises:

a timer generating a control signal in a predetermined time period; and a switching circuit transferring the counted number of pulses from the counter to an output in response to the control signal.

9. The display apparatus of claim 8, wherein the timer generates the control signal every 1 millisecond.

10. A display apparatus having an embedded micro controller, the micro controller comprising:

a counting circuit for counting a first number of pulses of the synchronization signal provided from a host, and generating a counted number of pulses in a predetermined time period;

a register for storing the first number of the pulses provided from the counting circuit;

a comparator for comparing a second number of pulses newly provided from the counting circuit with the first number of pulses stored in the register, and generating a resolution change sensing signal when the first number of pulses and the second number of pulses are different, wherein the counting circuit comprises a counter for counting the number of pulses of the synchronization signal from the host and for generating the counted number of pulses, and wherein the counter is reset by a control signal from the comparator, and a flag register set by an overflow signal of the synchronization signal, wherein the comparator does not compare the second number of pulses with the first number of pulses when the flag register is set.

11. The micro controller of claim wherein the counting circuit further comprises:

a timer generating a control signal in a predetermined time period; and a switching circuit transferring the counted number of pulses to an output in response to the control signal generated by the timer.

12. The micro controller of claim 11, wherein the timer generates the control signal every 1 millisecond.

13. The micro controller of claim 10, wherein the resolution change sensing signal serves as a signal for a video mute in the display apparatus.

14. A method for sensing resolution change in a display apparatus displaying a picture signal synchronized with a synchronization signal provided from a host, the method comprising the steps of:

generating a first counted number of pulses in a first predetermined time period by counting a first number of pulses of the synchronization signal from the host; generating a second counted number of pulses in a second predetermined time period by counting a second number of pulses of the synchronization signal from the host;

comparing the first counted number of pulses and the second counted number of pulses;

generating a resolution change sensing signal when the first counted number of pulses and the second counted number of pulses are different and the difference between the first counted number of pulses and the second counted number of pulses is not due to a frequency change caused by activation of a component of the synchronization signal; and generating a reset signal when the first counted number of pulses and the second counted number of pulses are the same.

15. The method of claim 14, the first counted number of pulses and the second counted number of pulses are generated every 1 millisecond.

16. A display apparatus for displaying a picture signal synchronized with a composite signal of a host horizontal synchronization signal and a host vertical synchronization signal, the display apparatus comprising:

a synchronization signal separator for dividing the composite signal into a horizontal synchronization signal and a vertical synchronization signal;

a counting circuit for counting a first number of pulses of the horizontal synchronization signal outputted from the synchronization signal separator, and generating a counted number of pulses every predetermined time period;

a register for storing the first number of pulses provided from the counting circuit;

a comparator for comparing a second number of pulses newly provided from the counting circuit with the first number of pulses stored in the register, and generating a resolution change sensing signal when the first number of pulses and the second number of pulses are different; and a flag register, wherein, when the vertical synchronization signal outputted from the synchronization signal separator is activated, the flag register is set and the comparator determines whether a difference between the first number of pulses and the second number of pulses is due to a resolution change or a frequency change in the composite signal resulting from activation of the host vertical synchronization signal.

17. A display apparatus for displaying a picture signal synchronized with a composite signal of a host horizontal synchronization signal and a host vertical synchronization signal, the display apparatus comprising:

a synchronization signal separator for dividing the composite signal into a horizontal synchronization signal and a vertical synchronization signal;

a counting circuit for counting a first number of pulses of the horizontal synchronization signal outputted from the synchronization signal separator, and generating a counted number of pulses every predetermined time period;

a register for storing the first number of pulses provided from the counting circuit; and a comparator for comparing a second number of pulses newly provided from the counting circuit with the first number of pulses stored in the register, and generating a resolution change sensing signal when the first number of pulses and the second number of pulses are different, wherein the horizontal synchronization signal outputted from the synchronization signal separator is the same as the composite signal.

18. A display apparatus for displaying a picture signal synchronized with a composite signal of a host horizontal synchronization signal and a host vertical synchronization signal, the display apparatus comprising:

a synchronization signal separator for dividing the composite signal into a horizontal synchronization signal and a vertical synchronization signal;

a counting circuit for counting a first number of pulses of the horizontal synchronization signal outputted from the synchronization signal separator, and generating a counted number of pulses every predetermined time period;

a register for storing the first number of pulses provided from the counting circuit;

a comparator for comparing a second number of pulses newly provided from the counting circuit with the first number of pulses stored in the register, and generating a resolution change sensing signal when the first number of pulses and the second number of pulses are different; and a flag register, wherein, when the vertical synchronization signal outputted from the synchronization signal separator is activated, the flag register is set and the comparator does not compare the second number of pulses with the first number of pulses.

* * * * *